US007306228B2

(12) United States Patent
Hosaka

(10) Patent No.: US 7,306,228 B2
(45) Date of Patent: Dec. 11, 2007

(54) GAME MACHINE

(75) Inventor: Toshiyuki Hosaka, Matsumae (JP)

(73) Assignee: Seiko Epson Corporation (JP)

( * ) Notice: Subject to any disclaimer, the term of this patent is extended or adjusted under 35 U.S.C. 154(b) by 882 days.

(21) Appl. No.: 10/637,715

(22) Filed: Aug. 8, 2003

(65) Prior Publication Data

US 2004/0110567 A1 Jun. 10, 2004

(30) Foreign Application Priority Data

Aug. 9, 2002 (JP) ..... 2002-233882
Jun. 11, 2003 (JP) ..... 2003-166840

(51) Int. Cl.
*A63F 3/00* (2006.01)

(52) U.S. Cl. ..... 273/287; 273/121 B; 463/46

(58) Field of Classification Search ..... 273/121 B, 273/118 R, 121 A; 446/176, 219; 463/46; 40/431

See application file for complete search history.

(56) References Cited

U.S. PATENT DOCUMENTS 5,462,277 A * 10/1995 Takemoto ..... 463/20
5,725,210 A * 3/1998 Yamaguchi et al. .... 273/121 B
7,040,619 B2 * 5/2006 Hosaka ..... 273/121 B
2004/0052078 A1 * 3/2004 Hosaka ..... 362/302
2004/0053688 A1 * 3/2004 Hosaka ..... 463/30
2004/0077397 A1 * 4/2004 Hosaka ..... 463/16
2004/0105003 A1 * 6/2004 Hosaka et al. ..... 348/157
2004/0142745 A1 * 7/2004 Hosaka ..... 463/31
2004/0147310 A1 * 7/2004 Hosaka ..... 463/25
2005/0020360 A1 * 1/2005 Hosaka ..... 463/31

FOREIGN PATENT DOCUMENTS

JP 07155442 A * 6/1995
JP 08266716 A * 10/1996
JP 2000167194 A * 6/2000
JP 2001314568 A * 11/2001

OTHER PUBLICATIONS

English translation of Ichihara et al. JP 08-266716, 5 pages.*
English translation of Nakamura et al. JP 2000-167194, 7 pages.*
English translation of Niimura et al. JP 07-155442, 9 pages.*
English translation of Sato et al. JP 2001-314568, 7 pages.*

* cited by examiner

*Primary Examiner*—Robert E. Pezzuto
*Assistant Examiner*—Alex F. R. P. Rada, II
(74) *Attorney, Agent, or Firm*—Harness, Dickey & Pierce, P.L.C.

(57) ABSTRACT

A pachinko machine board includes a game board on which nails, a start chucker, a big prize winning port and prize winning ports are fixed and a projection mechanism formed for projecting projection light from the rear surface of the game board to display images for a game on the game board. The game board includes a game board main body made of a light transmitting material so as to display the images for a game and nail fixing parts formed separately from the game board main body and attached to the game board main body. The nails, start chucker, big prize winning port and prize winning ports can be fixed to the nail fixing parts.

4 Claims, 10 Drawing Sheets

GAME MACHINE

BACKGROUND OF THE INVENTION

1. Technical Field

The present invention relates to a game machine comprising a game board and a projection mechanism formed so as to display images for a game by projecting projection light from the rear surface of the game board.

2. Related Art

As one type of a pachinko machine (game machine), JP-UM-A-7-24381 discloses a pachinko machine (pachinko machine board) which can project images for a game on a light transmitting optical image display part of a front panel (game board) by using a projector of a rear projection type (rear projection system). In this case, the projector includes components such as a liquid crystal display element and a light source and a projection lens is disposed between the projector and the game board. In this pachinko machine board, the projector firstly allows light emitted from the light source to pass through the liquid crystal display element and thus modulates the light to an optical image (projection light) and output the optical image. Then, the projection lens enlarges the projection light projected by the projector to project the enlarged projection light on the light transmitting optical image display part of the game board. Thus, an image for a game is displayed on the light transmitting optical image display part. In this case, the projection lens is operated so that the position or the area of the light transmitting optical image display part (that is, an area on which the image for a game is displayed) in the game board can be freely changed. Accordingly, the image for a game can be displayed over all the game board.

However, the rear projection type pachinko machine board has some problems as described below. That is, in the pachinko machine board, in order to visually recognize from a front surface the image for a game projected on the rear surface, all of the game board is formed of a light transmitting resin. A plurality of nails need to be fixed to the front surface of the game board. In this case, these nails are driven in from the front surface side of the game board by, for instance, a nailing machine. However, since the light transmitting resin is weak in withstanding impacts, there is a problem that the game board may be possibly broken due to the impact exerted upon driving the nails. Further, since the driven nails cannot be held with an adequate retaining force by the light transmitting resin, there is also a problem that the driven nails may become loose or slip due to an impact upon collision of game balls during a game or upon adjusting the nails. In this case, a method may be proposed that holes are formed on the game board and the nails are inserted into the holes and fixed thereto by, for example, an adhesive material. Even by using this fixing method, for instance, when a strong impact is exerted upon the nails, for example when adjusting the nails, the game board may be possibly still broken. Further, on the surface of the game board, various kinds of accessories (parts for a game) need to be fixed. In this case, these accessories are fixed by screwing (fastening), for instance, fixing screws to the game board. However, since the light transmitting resin is low in flexibility, when the fixing screws are tightly fastened, the game board may be possibly broken due to the fastening operation. Further, since the thus screwed fixing screws cannot be held with an adequate retaining force by the light transmitting resin, the fixed accessories (screwed fixing screws) may become loose due to an impact upon collision of game balls during a game. Therefore, means for preventing the breakage of the game board resulting from the impact exerted when driving the nails or adjusting the nails, and the fastening operation of the fixing screws is preferably provided. Further, means capable of preventing the loosening or slipping of the driven nails and the loosening of the fixed accessories is preferably provided.

The present invention is proposed by taking these problems into consideration. It is one object of the present invention to provide a game machine in which while a projected image for a game can be visually recognized, the breakage of a game board resulting from an impact exerted through nails and a fastening operation of fixing screws can be prevented. It is another object of the present invention to provide a game machine capable of preventing the loosening or slipping of nails and the loosening of fixed accessories due to an impact.

SUMMARY

In order to achieve the above-described objects, a game machine according to the present invention comprises a game board on which one or more kinds of either nails or accessories are fixed and a projection mechanism which projects projection light from the rear surface of the game board to display images for a game on the game board. The game board includes a game board main body made of a light transmitting material to display the images for a game and fixing parts (nail fixing parts) which are formed separately from the game board main body and attached to the game board main body and on which one or more kinds of the nails or the accessories can be fixed.

In the game machine according to the present invention, the fixing parts are made of at least one of a wooden material and a paper like material.

In the game machine according to the present invention, the fixing parts are fitted to fitting holes formed on the game board main body so as to fit the fixing parts thereto and attached to the game board main body.

In the game machine according to the present invention, the fixing parts are formed of a laminated wood.

In the game machine according to the present invention, the fixing parts are configured in forms imitating any form of an actual or imaginary creature, artificial objects, landscapes, characters and symbols.

In the above-described game machine, the game board includes a game board main body made of a light transmitting material to display the images for a game and fixing parts (nail fixing parts) which are formed separately from the game board main body and attached to the game board main body and on which one or more kinds of the nails or the accessories can be fixed. Accordingly, in manufacturing the game machine, since the game board main body and the fixing parts can be made of different materials, the fixing parts can be made of, for instance, a laminated wood which is strong for withstanding an impact, suitable for driving the nails and having an appropriate flexibility, which is different from the light transmitting material (for instance, polycarbonate) forming the game board main body. As a result, the breakage of the fixing parts and the game board main body resulting from an impact exerted through the nails or the fastening operation of, for instance, the fixing screws for fixing the accessories can be prevented while visually recognizing the projected image for a game. Further, since the fixing parts are formed with at least one of a wooden material or a paper like material, the fixing parts having an appropriate elasticity to distribute the impact to a periphery. Accordingly, the breakage of the game board (fixing parts and a game board main body) due to the impact exerted through the nails when driving the nails or adjusting the nails can be reliably prevented. Further, the fixing parts have an adequate retaining force for the driven nails or the screwed fixing screws. Accordingly, the loosening or slipping of the nails due to impacts with game balls or adjusting the nails and the loosening of the accessories due to impacts with game balls can be prevented during a game.

Still further, since the fixing parts are fitted to the fitting holes and attached to the game board main body, the surface of the game board main body can be flush with the surfaces of the fixing parts, the game balls can be smoothly moved. Further, since the fixing parts are made of laminated wood, the fixing parts can be uniformly held throughout all the peripheries of the driven nails. Consequently, the loosening or the slipping of the nails can be reliably prevented relative to impacts from any direction.

Since the fixing parts are formed in the shapes imitating any shape of actual or imaginary creatures, artificial objects, landscapes, characters and symbols, the fixing parts can function as parts of picture patterns.

DETAILED DESCRIPTION

Now, referring to the attached drawings, preferred embodiments of a game machine according to the present invention will be described below.

Figure 1:
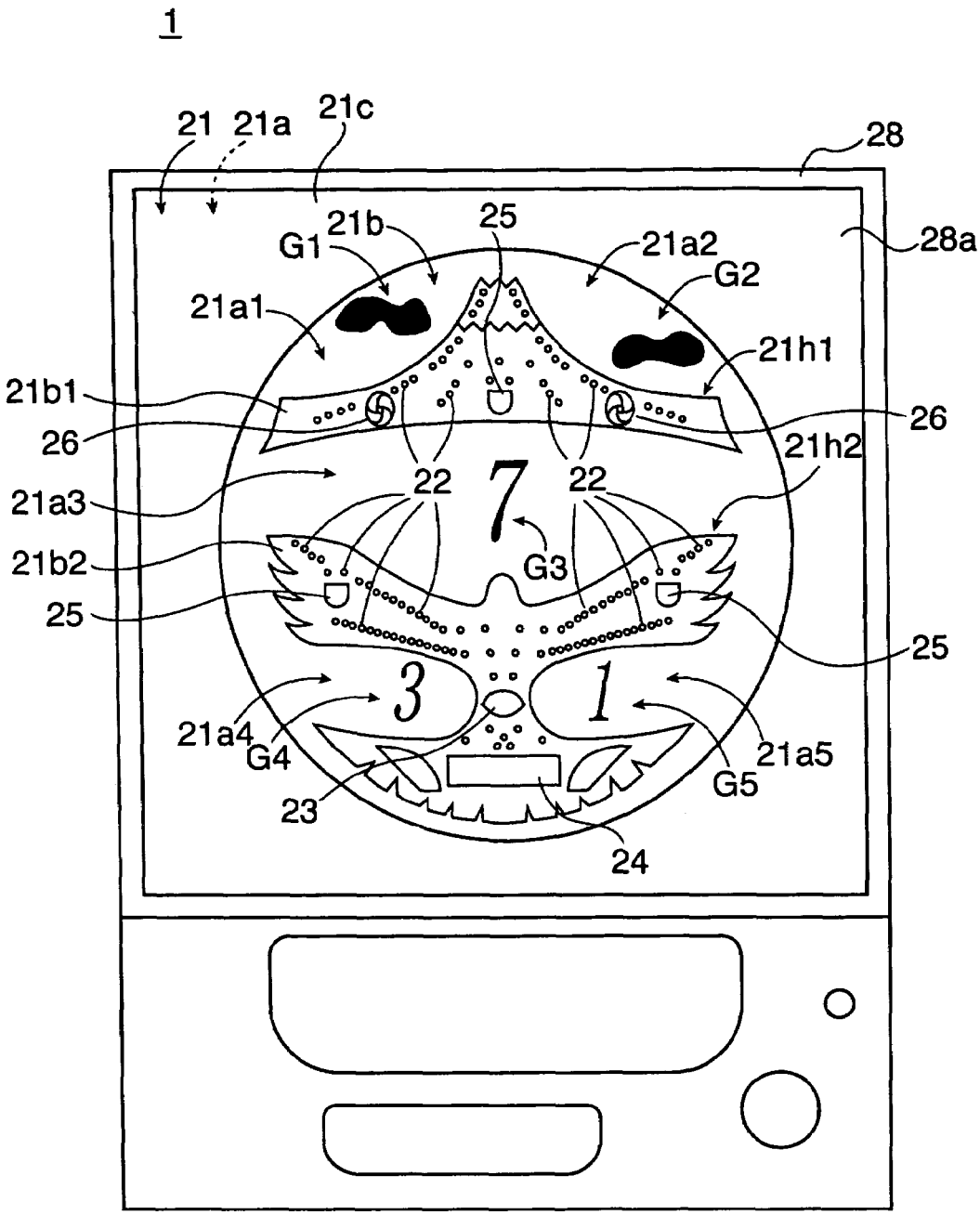
FIG. 1 is a front view showing a schematic structure of a pachinko machine board 1.
Figure 2:
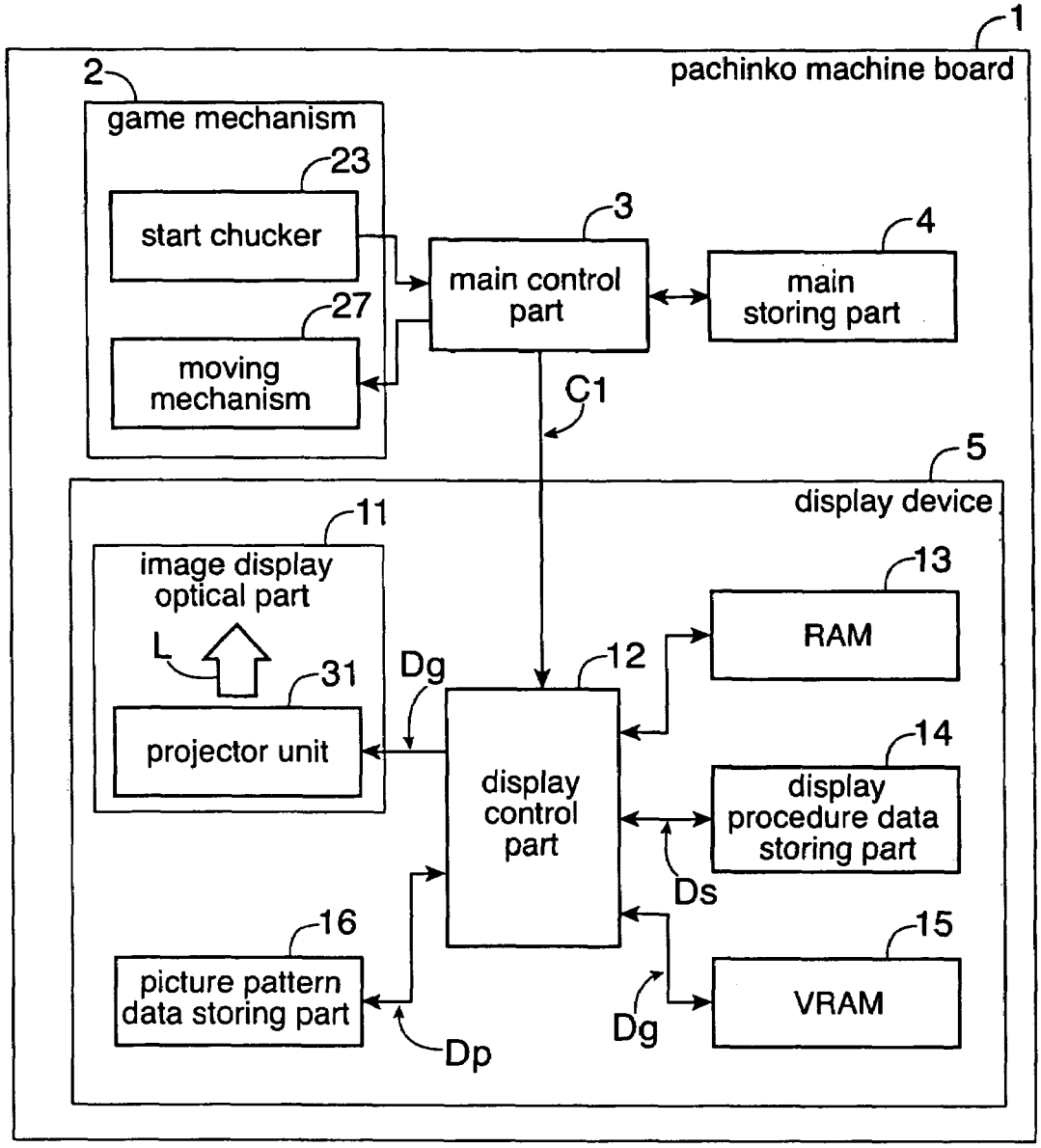
FIG. 2 is a block diagram showing the structure of the pachinko machine board 1.

Firstly, the structure of a pachinko machine board 1 will be described by referring to the drawings. The pachinko machine board (game machine) 1 is a "seven machine" type pachinko machine board as one example in which a "big hit" is generated by a lottery. As shown in FIG. 1, on a plurality of image display parts 21*a*1 to 21*a*5 formed on a game board 21, images G1 to G5 for a game (for instance, clouds or figures shown in FIG. 1) can be respectively displayed by a rear projection system. Specifically, this pachinko machine board 1 includes, as shown in FIG. 2, a game mechanism 2, a main control part 3, a main storing part 4 and a display device 5.

Figure 3:
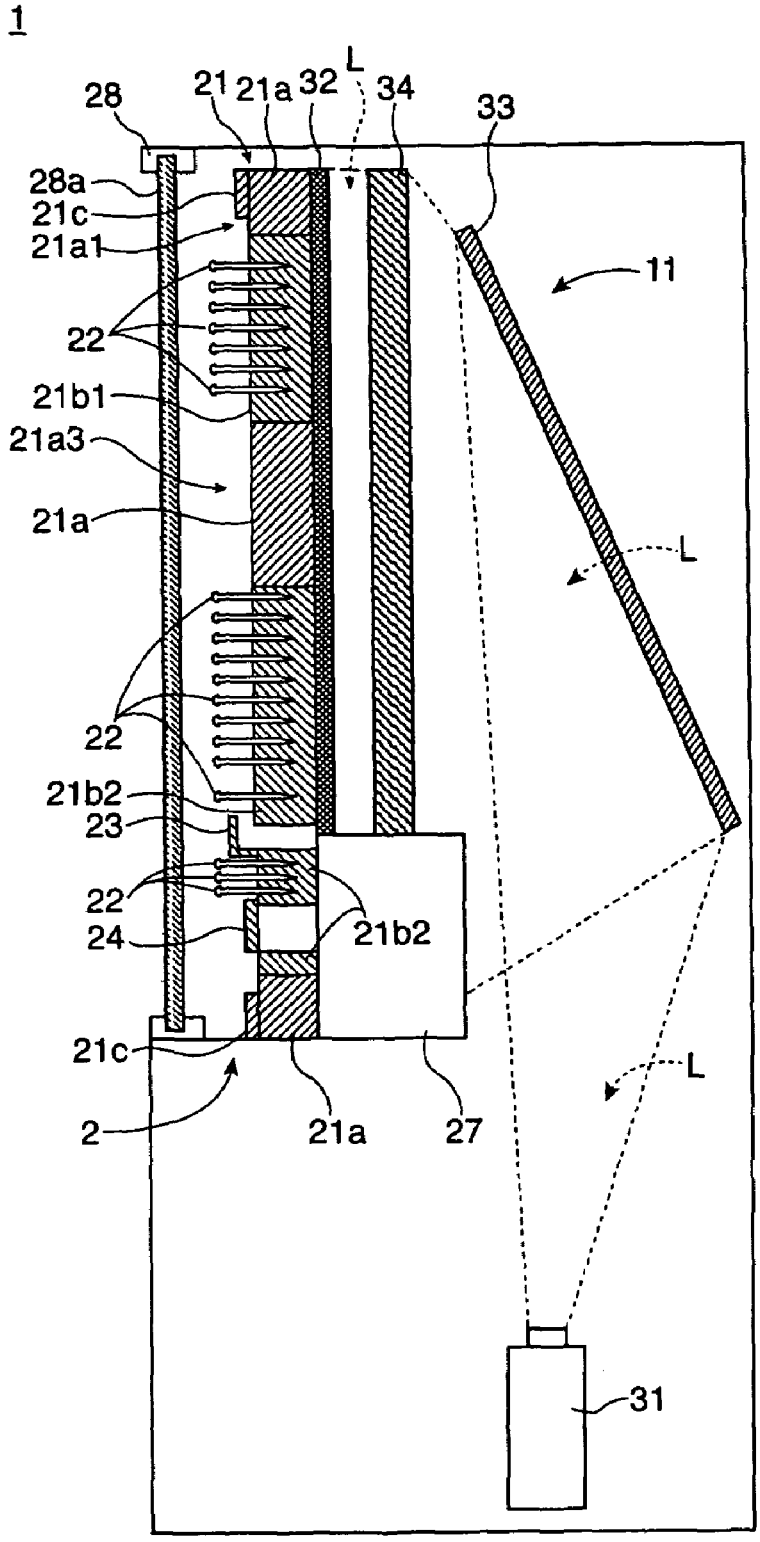
FIG. 3 is a side sectional view showing the schematic structure of the pachinko machine board 1.
Figure 4:
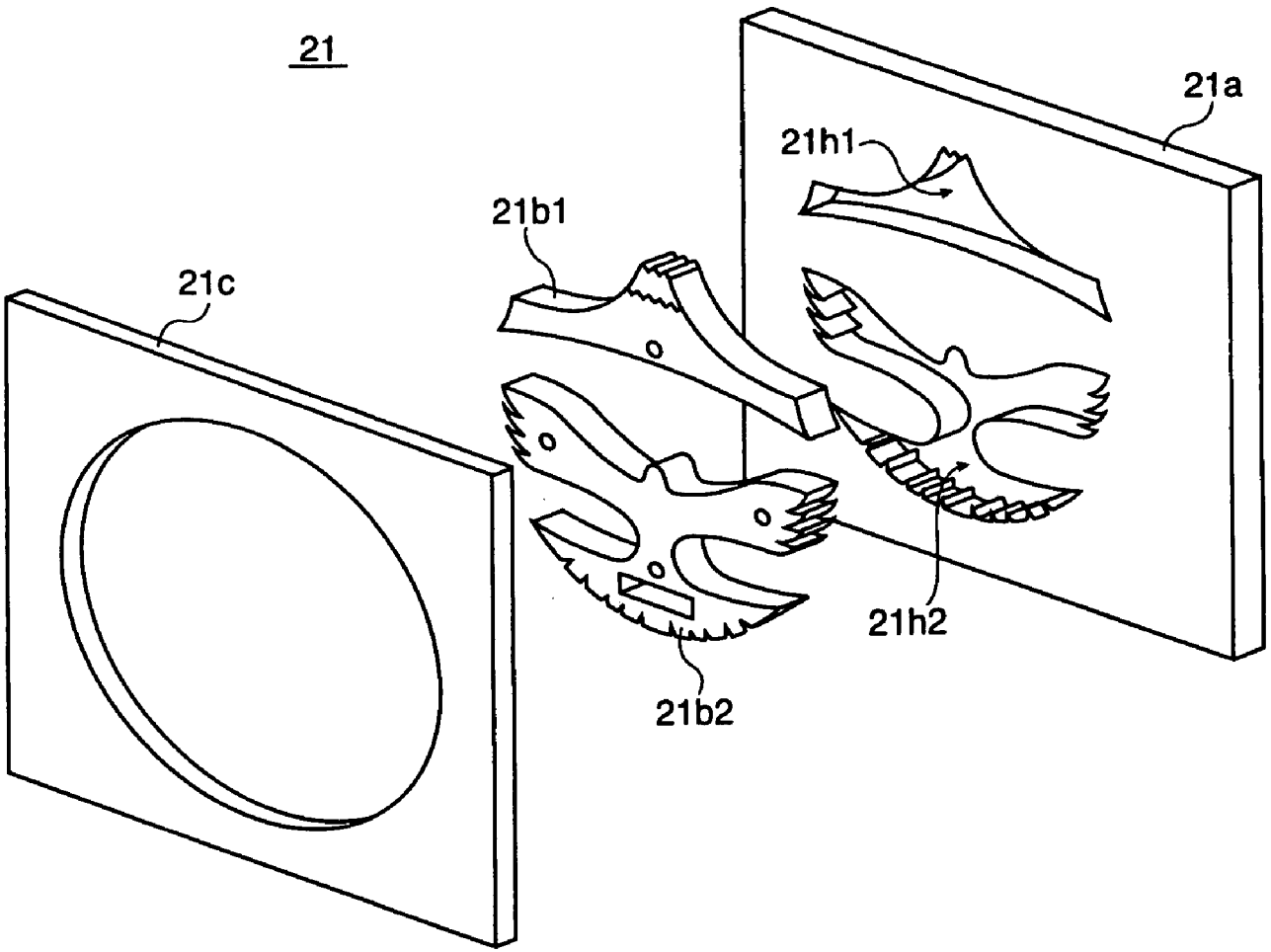
FIG. 4 is an exploded perspective view showing the structure of a game board 21.

The game mechanism 2 includes, as shown in FIG. 3, the game board 21 and a moving mechanism 27. The game board 21 includes, as shown in FIG. 1, a game board main body 21*a* (see FIG. 4), nail fixing parts (fixing parts) 21*b*1 and 21*b*2 and a decorative panel 21*c*. The game board main body 21*a* is, as shown in FIG. 4, made of a light transmitting resin (as one example, polycarbonate) and formed in, for instance, a rectangular plate shape in a front view. Further, the game board main body 21*a* has a hole (fitting hole) 21*h*1 formed with the same shape as that of the nail fixing part 21*b*1 in a slightly upper side on a central part. The game board main body 21*a* has a hole (fitting hole) 21*h*2 formed with the same shape as that of the nail fixing part 21*b*2 in a slightly lower side on a central part.

The nail fixing part 21*b*1 is formed in the shape imitating, for instance, Mt. Fuji by a plate shaped wooden member having the same thickness as that of the game board main body 21*a* (as one example of a wooden material in the present invention, a laminated wood formed by sequentially laminating wooden thin plates so that the directions of fibers intersect perpendicularly). In this case, the nail fixing part 21*b*1 is fitted to the hole 21*h*1 and fixed to the game board main body 21*a* by, for example, an adhesive agent so that its surface is flush with the surface of the game board main board 21*a*. On the surface of the nail fixing part 21*b*1, a plurality of pegs or nails 22,22 . . . and windmills 26 and 26 are driven and fixed and a prize winning port 25 (corresponding to accessories in the present invention as well as a below described start chucker 23 and a big prize winning port 24) is fitted to a fitting hole and fixed by a fixing screw (not shown).

The nail fixing part 21*b*2 is, as shown in FIGS. 1 and 4, formed by the same laminated wood as that of the nail fixing part 21*b*1 in the shape imitating, for instance, a bird. In this case, the nail fixing part 21*b*2 is fitted to the hole 21*h*2 and fixed to the game board main body 21*a* by such as an adhesive agent so that its surface is flush with the surface of the game board main body 21*a*. On the surface of the nail fixing part 21*b*2, a plurality of nails 22, 22 . . . are driven and fixed and the start chucker 23, the big prize winning port (attacker) 24 and prize winning ports 25 an 25 (referred to also as "accessories" hereinafter when they are not discriminated) are respectively fitted to fitting holes and fixed by fixing screws.

In this case, since the laminated wood has elasticity when the nails 22 are driven or adjusted, the laminated wood disperses an impact exerted through the nails 22 to a periphery. As a result, the breakage of the nail fixing parts 21*b*1 and 21*b*2 and the game board main body 21*a* resulting from the impact can be prevented. Further, since the laminated wood has flexibility, the breakage of the nail fixing parts 21*b*1 and 21*b*2 and the game board main body 21*a* due to the fastening operation of the fixing screws is prevented. Still further, since the laminated wood has a holding force for adequately holding the driven nails 22 or the screwed fixing screws, the loosening or the slipping of the nails 22 and the loosening of the accessories (via the fixing screws) due to an impact are prevented. In this case, since the laminated wood is formed by sequentially laminating wooden thin plates so that the directions of fibers intersect perpendicularly, a substantially uniform holding force holds the peripheries of the driven nails 22. Consequently, the loosening or the slipping of the nails 22 is prevented relative to impacts in any direction.

As shown in FIG. 4, the decorative panel 21*c* is formed with a resin having a light shielding property (as one example, a colored resin) so that its external form has, for instance, a plate shape the same as that of the game board main body 21*a*. The decorative panel 21*c* has a central part cut out in a circular form. Further, the decorative panel 21*c* is attached to the surface of the game board main body 21*a* by, for instance, the fixing screws. In this case, as shown in FIG. 1, the central part of the decorative panel 21*c* is cut out in a circular form. Thus, a circular game part 21*d* (a part in which game balls move during a game) which is not covered with the decorative panel 21*c* is formed in the central part of the game board main body 21*a*. Further, in the game part 21*d*, the image display parts 21*a*1 to 21*a*5 partitioned by the nail fixing parts 21*b*1 and 21*b*2 are formed. As shown in FIG. 3, a door 28 to which a transparent cover glass 28*a* is fitted is attached to the front surface of the game board 21. As shown in FIG. 3, the moving mechanism 27 opens the big prize winning port 24 in accordance with the instruction of the main control part 3 attached to the back surface of the nail fixing part 21*b*2.

The main control part 3 generally controls the pachinko machine board 1 and performs a lottery when the game ball wins a prize in the start chucker 23. Further, the main control part 3 outputs a command C1 upon change of a game state, for instance, upon start of the lottery or the generation of a big hit to allow a below-described display control part 12 to perform an image display process. The main storing part 4 stores an operation program of the main control part 3.

The display device 5 includes, as shown in FIG. 2, an image display optical part 11, the display control part 12, a RAM 13, a display procedure data storing part 14, a VRAM 15 and a picture pattern data storing part 16. The image display optical part 11 includes, as shown in FIG. 3, a projector unit 31, a screen film 32, a mirror 33 and a Fresnel lens 34. The projector unit 31 corresponds to a projection mechanism in the present invention and emits projection light L modulated on the basis of displaying image data Dg outputted by the display control part 12. Specifically, the projector unit 31 includes, for instance, a light source lamp, modulating means (as one example, a liquid crystal light bulb having a liquid crystal panel, an incident side polarizing plate and an output side polarizing plate) for modulating white color light emitted by the light source lamp to the projection light L and a projection lens for enlarging and projecting the projection light L (none of them are shown). Further, the projector unit 31 is disposed at a position near a bottom surface in the pachinko machine board 1 and emits the projection light L, for example, upward.

The screen film 32 is secured to the back surface of the game board 21. The screen film 32 receives and scatters, as one example, the projection light L projected by the projector unit 31, so that the images G1 to G5 for a game shown in, for instance, FIG. 1 are formed. In this case, the images G1 to G5 for a game are formed as one synthesized image for a game by connecting the images G1 to G5 for a game together by background images. The mirror 33 is disposed in the back surface side of the game board 21 to reflect the projection light L projected by the projector unit 31 toward the screen film 32. The Fresnel lens 34 is disposed between the mirror 33 and the screen film 32. The Fresnel lens 34 converts the projection light L projected by the projector unit 31 into parallel light (parallel light, broadly speaking) and projects it on the screen film 32.

The display control part 12 is a control part exclusively used for displaying an image. The display control part 12 performs various kinds of image displaying processes in accordance with the command C1 outputted by the main control part 3 to output the displaying image data Dg for displaying, for instance, the synthesized image for a game formed by synthesizing the images G1 to G5 for a game to the projector unit 31. The RAM 13 temporarily stores various kinds of data formed by the display control part 12. The display procedure data storing part 14 stores display procedure data Ds in which the designations of picture patterns respectively used for the images G1 to G5 for a game, and the display positions and sizes of the images G1 to G5 for a game are described or the operation program of the display control part 12. The VRAM 15 stores the displaying image data Dg, which is generated such that the display control part 12 virtually drawing an image. The picture pattern data storing part 16 stores various kinds of picture pattern data Dp (data such as clouds and figures, etc.) for forming the displaying image data Dg.

Now, a method for manufacturing the game board 21 will be described by referring to the drawings. Firstly, as shown in FIG. 4, on the central part of a plate shaped member made of the light transmitting resin (in this embodiment, polycarbonate) and formed to have a prescribed shape (in this embodiment, rectangular shape) and a thickness, the holes 21*h*1 and 21*h*2 respectively having the same shapes of those of the nail fixing parts 21*b*1 and 21*b*2 are formed. Thus, as shown in FIG. 4, the game board main body 21*a* is manufactured. In this case, the game board main body 21*a* on which the holes 21*h*1 and 21*h*2 are formed by, for instance, an injection molding may be formed. Then, the laminated wood having the same thickness as that of the game board main body 21*a* is cut out to form the nail fixing parts 21*b*1 and 21*b*2 shown in FIG. 4. At this time, the holes to which the start chucker 23, the big prize winning port 24 and the prize winning ports 25 are fitted are respectively formed at prescribed positions.

Then, the decorative panel 21*c* shown in FIG. 4 is formed by, for instance, an injection molding. Subsequently, the nail fixing parts 21*b*1 and 21*b*2 are respectively fitted and fixed to the holes 21*h*1 and 21*h*2 of the game board main body 21*a* by, for example, an adhesive agent. Then, the nails 22 are driven by a nailing machine at the prescribed positions on the nail fixing parts 21*b*1 and 21*b*2 fitted to the game board main body 21*a*. In this case, since the nail fixing parts 21*b*1 and 21*b*2 are made of the laminated wood, the impact exerted when driving the nails 22 is dispersed to the periphery due to the elasticity of the laminated wood. Accordingly, the breakage of the nail fixing parts 21*b*1 and 21*b*2 and the game board main body 21*a* is prevented. Then, the windmills 26 and 26 are driven and fixed at prescribed positions of the nail fixing part 21*b*1 and the prize winning port 25 is fitted to the fitting hole of the nail fixing part 21*b*1 and fixed thereto by the fixing screw. Subsequently, the start chucker 23, the big prize winning port 24 and the prize winning ports 25 are respectively fitted to the fitting holes of the nail fixing part 21*b*2 and fixed thereto by the fixing screws. In this case, the laminated wood has flexibility. Accordingly, even when the fixing screws are tightly fastened, the nail fixing parts 21*b*1 and 21*b*2 and the game board main body 21*a* are not broken and the accessories are respectively reliably fixed to the nail fixing parts 21*b*1 and 21*b*2. if desired, the nail fixing parts 21*b*1 and 21*b*2 may be fitted and fixed to the holes 21*h*1 and 21*h*2 after the nails 22, the start chucker 23, the big prize winning port 24, the prize winning ports 25 and the windmills 26 are previously fixed to the nail fixing parts 21*b*1 and 21*b*2. Then, the decorative panel 21*c* is attached to the surface of the game board main body 21*a* by the fixing screws. Thus, the game machine board 21 is completed.

Now, an entire operation of the pachinko machine board 1 will be described by referring to the drawings. In the pachinko machine board 1, when a power source is turned on, the main control part 3 firstly outputs the command C1 for displaying the images G1 to G5 for a game in, for instance, an ordinary game state shown in FIG. 1 (a state that game balls do not enter the start chucker 23). The display control part 12 performs an image display process in response thereto. In the image display process, the display control part 12 reads the display procedure data Ds designated by the command C1 from the display procedure data storing part 14. Then, the display control part 12 forms the displaying image data Dg for displaying the synthesized image for a game obtained by synthesizing the images G1 to G5 for a game in accordance with the display procedure. At this time, the display control part 12 reads the picture pattern data Dp, Dp . . . necessary for forming the displaying image data Dg from the picture pattern data storing part 16 to virtually draw (store picture pattern data Dp) picture patterns corresponding to the picture pattern data Dp, Dp . . . on a virtual plane of the VRAM 15. Thus, the displaying image data Dg is formed in the VRAM 15. Subsequently, the display control part 12 outputs the displaying image data Dg in the VRAM15 to the projector unit 31. The above-described image processes are continuously performed until a new command C1 is inputted.

The projector unit 31 projects the projection light L for displaying the synthesized image for a game obtained by synthesizing the images G1 to G5 for a game on the basis of the outputted displaying image data Dg. Thus, the synthesized image for a game formed by synthesizing the images G1 to G5 for a game is formed on the screen film 32 that is secured to the back surface of the game board 21. At this time, the image display parts 21*a*1 to 21*a*5 respectively transmit the images G1 to G5 for a game of the thus formed synthesized image for a game. Thus, as shown in FIG. 1, the images G1 to G5 for a game in an ordinary game state are respectively displayed on the image display parts 21*a*1 to 21*a*5. In this case, as one example, the images G1 and G2 for a game are formed in the picture patterns of stationary clouds. The images G3 to G5 for a game are formed in figures of large size (in the example of FIG. 1, "7", "3" and "1") stationary at positions near the central part of the game board 21.

Figure 5:
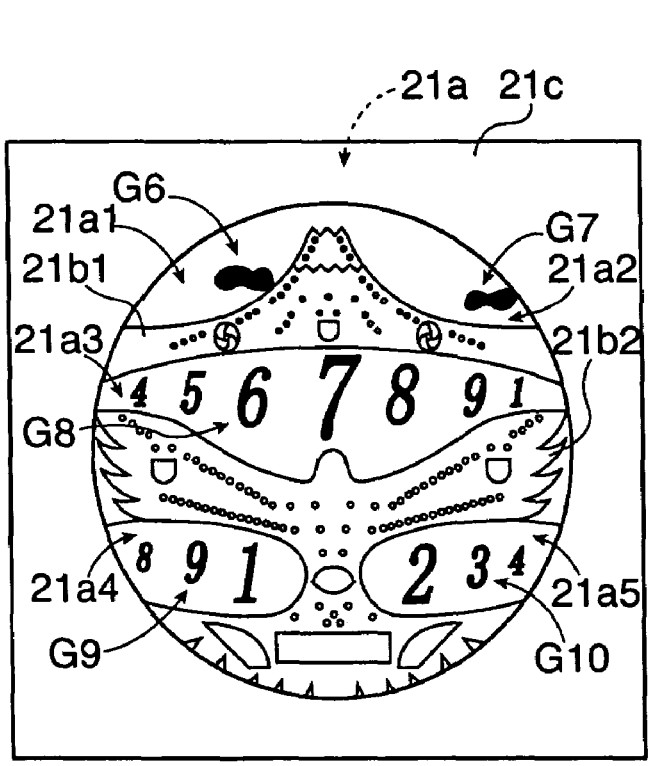
FIG. 5 is a front view of the game board 21 in which images G6 to G10 for a game are displayed.

Then, when the game is started, the game balls collide with the nails 22 or the accessories and drop to a lower part from an upper part while they change directions in a complicated manner. At this time, the laminated wood forming the nail fixing parts 21*b*1 and 21*b*2 holds the nails 22 or the fixing screws of the accessories with an adequate holding force. Therefore, the loosening or the slipping of the nails 22 and the loosening of the accessories due to impacts with the game balls are prevented. On the other hand, when the game balls enter the start chucker 23, the main control part 3 performs a lottery. The main control part 3 outputs a command C1 for displaying a synthesized image for a game obtained by synthesizing images G6 to G10 for a game which indicates, for instance, a lottery state shown in FIG. 5 to the display control part 12. The display control part 12 performs the above-described image display process in response thereto to form displaying image data Dg for displaying the synthesized image for a game obtained by synthesizing the images G6 to G10 for a game and output the data Dg to the projector unit 31. The projector unit 31 emits projection light L in response thereto, so that the images G6 to G10 for a game shown in FIG. 5 are respectively displayed on the image display parts 21*a*1 to 21*a*5. In this case, as one example, the images G6 and G7 for a game are formed in picture patterns of clouds moving from the left to the right. The images G8 to G10 are respectively formed in figures of 1 to 9 which become the larger in their size when they are located nearer to the central part by scrolling them transversely.

Then, when the result of the lottery is a "miss", the main control part 3 outputs a command C1 for respectively displaying images for a game to show the result of the lottery. Thus, in the result of the lottery, for instance, the moving speed of the clouds in the images G6 and G7 for a game and scrolling speed in the images G8 to G10 for a game are gradually lowered to finally stop the images. In response thereto, the display control part 12 performs the image display process to output displaying image data Dg. Thus, the images for a game for gradually lowering the moving speed of the clouds are respectively displayed on the image display parts 21*a*1 and 21*a*2. The images for a game for gradually lowering the scrolling speed of the figures are respectively displayed on the image display parts 21*a*3 to 21*a*5. After that, the images for a game with the picture patterns of motionless clouds are respectively displayed on the image display parts 21*a*1 and 21*a*2. Further, the images for a game representing the results of the lottery composed of the stopping figures of large size are respectively displayed on the image display parts 21*a*3 to 21*a*5.

Figure 6:
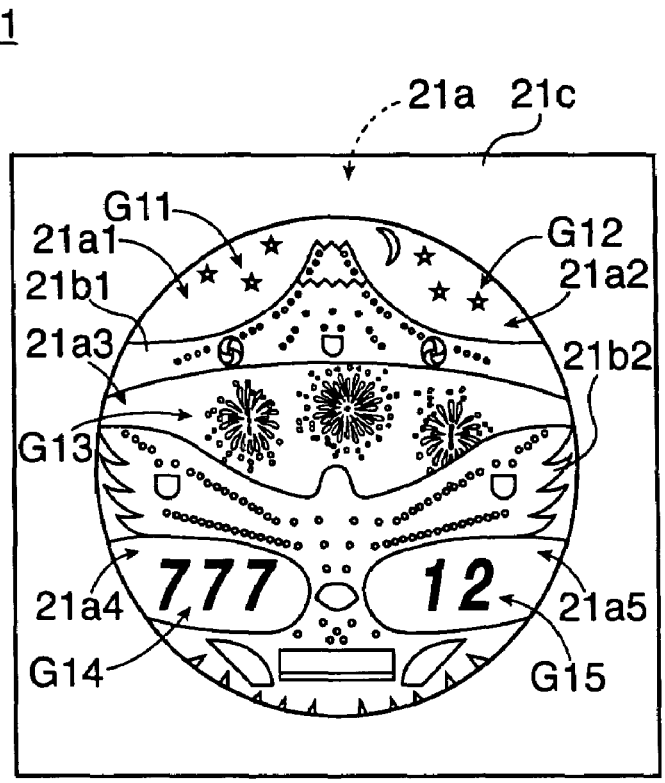
FIG. 6 is a front view of the game board 21 in which images G11 to G15 for a game are displayed.

Subsequently, when the game balls enter the start chucker 23 again, the main control part 3 performs the above-described lottery and outputs a command C1 for displaying the images G6 to G10 for a game representing a lottery state. Thus, the images G6 to G10 for a game are displayed. Then, as a result of the lottery, when a big hit is generated, the main control part 3 outputs a command C1 for displaying images for a game respectively showing the result of the lottery. Accordingly, the images for a game showing the result of the lottery are respectively displayed on the image display parts 21*a*3 to 21*a*5. In this case, each figure, which forms each image for a game and is displayed on the image display parts 21*a*3 to 21*a*5, is specified to be the same figures (for instance, "7", "7" and "7"). Consequently, a player is informed of the generation of the big hit. Then, the main control part 3 outputs a command C1 for displaying images G11 to G14 for a game showing a "generation of big hit" shown in FIG. 6 to the display control part 12. The display control part 12 performs an image display process in response thereto to output displaying image data Dg to the projector unit 31. Thus, the images G11 to G14 for a game shown in FIG. 6 are respectively displayed on image display parts 21*a*1 to 21*a*4. In this case, as one example, the images G11 and G12 for a game are formed in picture patterns showing a night sky in which stars or the moon is drawn. The image G13 for a game is formed in an animation image that fireworks are shot. Further, the image G14 for a game is formed in an image that the figures of a big hit (for instance, figures of "777") flickers.

Subsequently, the main control part 3 opens the door of the big prize winning port 24, for instance, for only 15 times relative to the moving mechanism 27. At this time, the main control part 3 outputs a command C1 for displaying an image G15 for a game showing the number of rounds of opening and closing the big prize winning port 24 to the display control part 12. The display control part 12 outputs displaying image data Dg in response thereto to display the image G15 for a game on an image display part 21*a*5. Then, the main control part 3 outputs a command C1 for displaying ending images (not shown) which represent the ending of the big hit when the opening of the big prize winning port 24 is ended (end of a big hit). The display control part 12 performs an image display process in response thereto to output displaying image data Dg. Thus, the ending images are displayed on the image display parts 21*a*1 to 21*a*5. After that, every time the game balls enter the start chucker 23, the above-described processes are performed.

For instance, after the game is ended (after a pachinko hall is closed), when the nails of the pachinko machine board 1 are adjusted, the head parts (parts protruding on the front surface sides of the nail fixing parts 21*b*1 and 21*b*2) of the nails 22 fixed to the nail fixing parts 21*b*1 and 21*b*2 are struck by using a hammer for adjusting the nails. Thus, the angles of the nails 22 and intervals between the nails 22 are adjusted. At this time, since the laminated wood forming the nail fixing parts 21*b*1 and 21*b*2 has elasticity and disperses an impact exerted through the nails 22 to a periphery, the breakage of the nail fixing parts 21*b*1 and 21*b*2 and the game board main body 21*a* is prevented. Further, since the laminated wood has an adequate holding force relative to the nails 22, the loosening or the slipping of the nails 22 due to the impact upon adjusting the nails is prevented.

As described above, in the pachinko machine board 1, the game board 21 comprises the game board main body 21*a* made of, for instance, polycarbonate and capable of displaying the images G1 to G5 for a game and the nail fixing parts 21*b*1 and 21*b*2 formed separately from the game board main body 21*a* and attached to the game board main body 21*a*. Accordingly, in manufacturing the pachinko machine board 1, the game board main body 21*a* and the nail fixing parts 21*b*1 and 21*b*2 can be made of different materials. Thus, the nail fixing parts 21*b*1 and 21*b*2 can be formed with, for instance, the laminated wood that is strong against impact, suitable for driving the nails and has a suitable flexibility, which is different from polycarbonate forming the game board main body 21*a*. Consequently, the damage of the nail fixing parts 21*b*1 and 21*b*2 and the game board main body 21*a* resulting from the impact exerted through the nails 22 or the fastening operation of the fixing screws for fixing the accessories can be prevented while the projected images G1 to G15 for a game are visually recognized. Further, the nail fixing parts 21*b*1 and 21*b*2 are formed with the laminated wood, and the laminated wood has a suitable elasticity to disperse an impact to a periphery. Accordingly, the breakage of the nail fixing parts 21*b*1 and 21*b*2 and the game board main body 21*a* due to the impact exerted through the nails 22 upon driving the nails 22 or adjusting the nails can be reliably prevented. Further, since the laminated wood has an adequate holding force for the driven nails 22 or the screwed fixing screws, the nails 22 can be prevented from loosening or slipping due to impacts upon collision with the game balls or adjustment of the nails during a game. Further, the accessories (via fixing screws) can be prevented from being loosened due to impacts when the game balls collide during a game.

Further, the nail fixing parts 21*b*1 and 21*b*2 are respectively fitted to the holes 21*h*1 and 21*h*2 of the game board main body 21*a*. Accordingly, the surface of the game board main body 21*a* can be flush with the surfaces of the nail fixing parts 21*b*1 and 21*b*2 without generating steps. Therefore, the game balls can be smoothly moved. Further, the nail fixing parts 21*b*1 and 21*b*2 are formed with the laminated wood formed by laminating wooden thin plates so that the directions of their fibers intersect perpendicularly. Thus, the driven nails 22 can be uniformly held throughout (around) all the peripheries thereof. Consequently, the loosening or the slipping of the nails 22 can be reliably prevented relative to impacts in any direction. Further, the nail fixing part 21*b*1 is formed in the shape imitating Mt. Fuji and the nail fixing part 21*b*2 is formed in the shape imitating a bird, so that both the nail fixing parts 21*b*1 and 21*b*2 can function as parts of the picture patterns.

Now, a pinball machine (game machine) 41 according to another embodiment of the present invention will be described by referring to the drawings. The present invention is basically applied to the pinball machine 41 in the same manner as that of the pachinko machine board 1. Accordingly, the same component elements as those of the pachinko machine board 1 are designated by the same reference numerals and a duplicated explanation thereof is omitted. The pinball machine 41 shown in FIG. 7 comprises, as shown in FIG. 8, a game board 42 disposed inside a machine main body and an image display optical part 43 disposed in an inner part of the machine main body. In the pinball machine 41, game balls 46 (see FIG. 10) are moved between the game board 42 and a glass plate 44 provided on the upper surface of the machine main body to play a pinball game.

Figure 7:
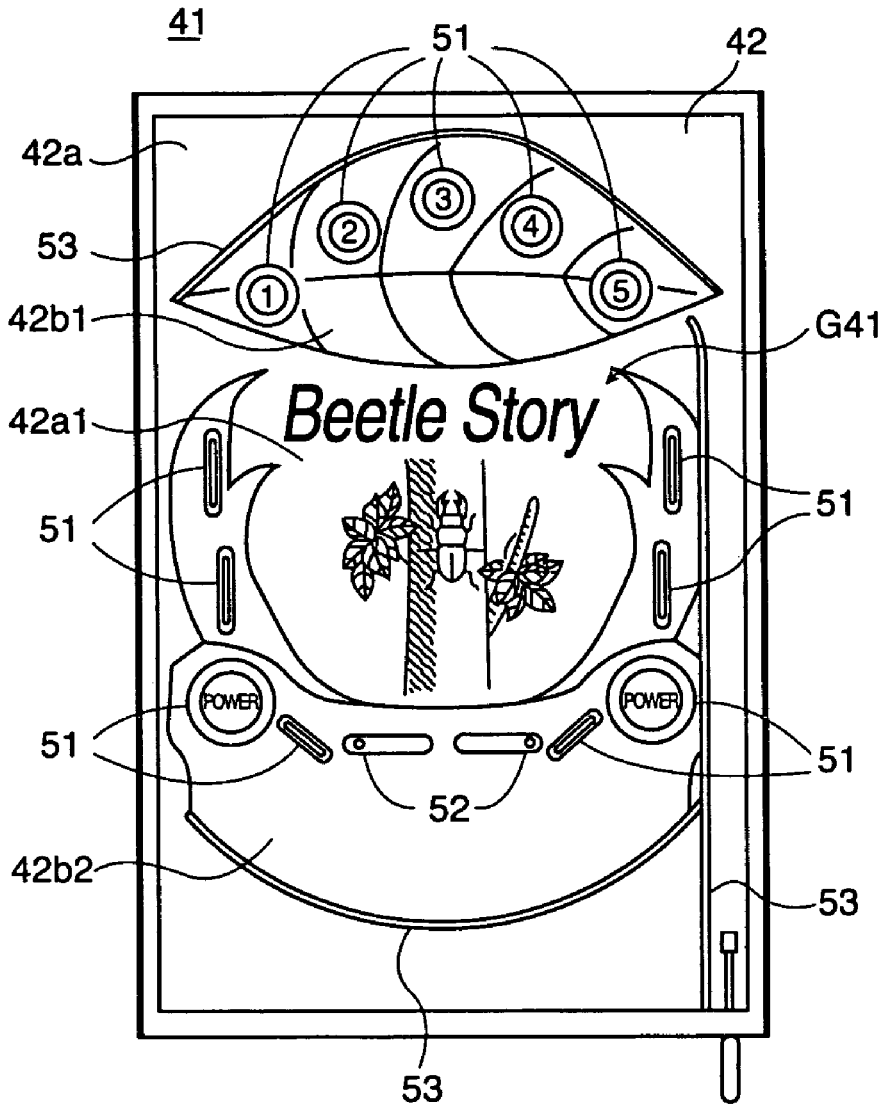
FIG. 7 is a plan view showing a schematic structure of a pinball machine 41.
Figure 8:
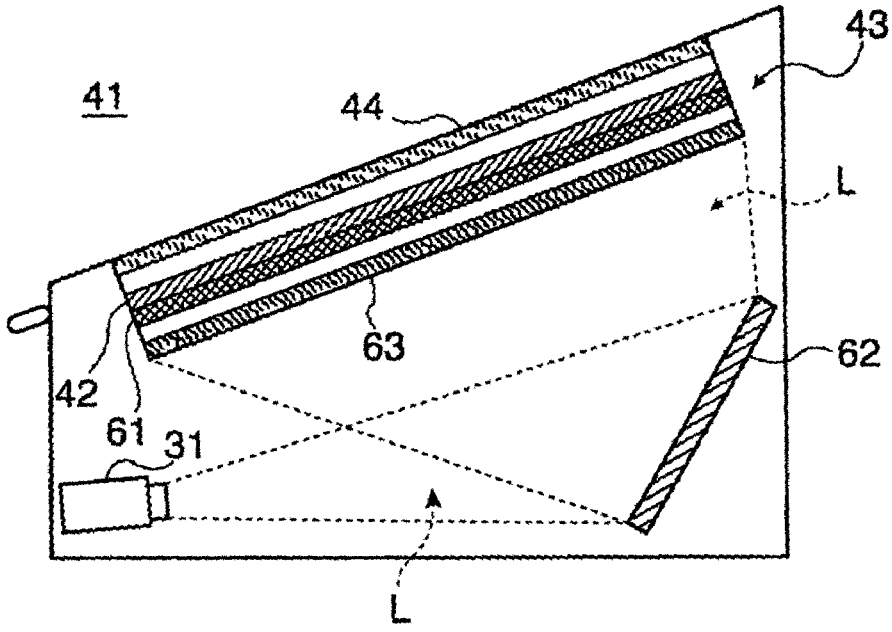
FIG. 8 is a side sectional view showing the schematic structure of the pinball machine 41.
Figure 9:
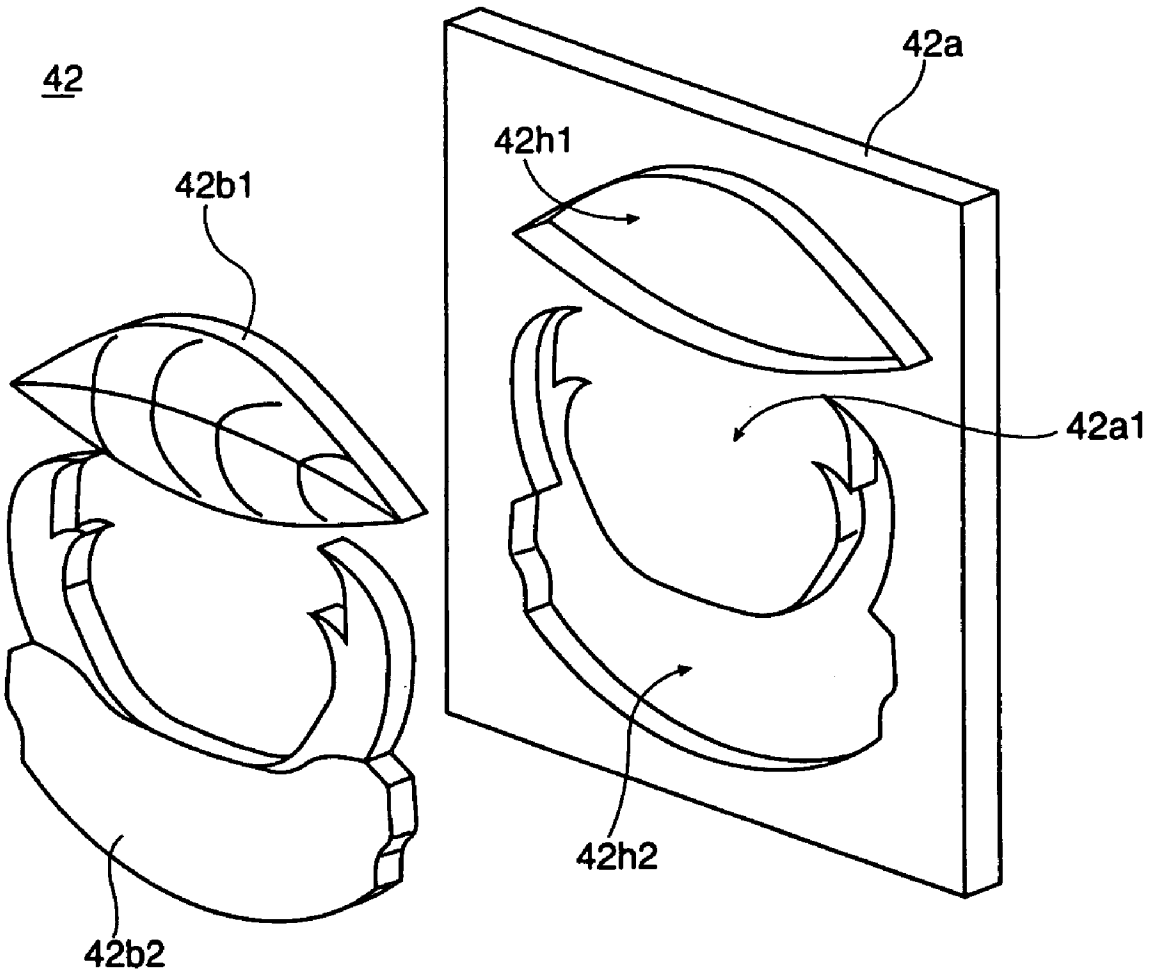
FIG. 9 is an exploded perspective view showing a structure of a game board 42.

The game board 42 includes, as shown in FIGS. 7 and 9, a game board main body 42*a* and accessory fixing parts (fixing parts) 42*b*1 and 42*b*2. The game board main body 42*a* is formed in, for instance, a rectangular plate shape in a front view by a light transmitting resin (as one example, polycarbonate), as shown in FIG. 9. Further, the game board main body 42*a* has a hole (fitting hole) 42*h*1 formed with the same form as that of the accessory fixing part 42*b*1 in an upper side thereof and a hole (fitting hole) 42*h*2 formed with the same form as that of the accessory fixing part 42*b*2 in a lower side thereof.

As shown in FIG. 9, the accessory fixing part 42*b*1 is formed in, for instance, a shape imitating a leaf by a laminated wood with the same thickness as that of the game board main body 42*a*. In this case, the accessory fixing part 42*b*1 is fitted to the hole 42*h*1 so that the surface of the accessory fixing part is flush with the surface of the game board main body 42*a* and fixed to the game board main body 42*a* by, for example, an adhesive agent. Further, as shown in FIG. 7, a plurality of bumpers 51, 51 . . . and a frame member 53 for partitioning a moving range of the game balls 46 are fixed to the surface side of the accessory fixing part 42*b*1 by fixing screws. In this case, the bumpers 51 correspond to accessories in the present invention. The bumpers spring back the game balls 46 when the game balls 46 collide therewith during the game of the pinball machine, detect the collision of the game balls 46 and outputs a detecting signal to a main control part 3 through a wiring not shown in the drawing.

As shown in FIG. 9, the accessory fixing part 42*b*2 is formed in a shape imitating, for instance, an insect (in this case, a head of a beetle) by the laminated wood the same as that of the accessory fixing part 42*b*1. In this case, the accessory fixing part 42*b*2 is fitted to the hole 42*h*2 so that the surface of the accessory fixing part is flush with the surface of the game board main body 42*a* and fixed to the game board main body 42*a* by, for example, an adhesive agent. Further, as shown in FIG. 7, a plurality of bumpers 51, 51 . . . , flippers 52 and 52 and frame members 53 and 53 are fixed to the surface side of the accessory fixing part 42*b*2 by fixing screws.

In this case, as shown in FIG. 7, on the game board main body 42*a*, an image display part 42*a*1 partitioned (surrounded) by the accessory fixing parts 42*b*1 and 42*b*2 to display, for instance, an image G41 for a game is formed.

The image display optical part 43 includes, as shown in FIG. 8, a screen film 61 secured to the back surface of the game board 42, a mirror 62, a Fresnel lens 63 and a projector unit 31.

In manufacturing the game board 42 of the pinball machine 41, as shown in FIG. 9, the holes 42*h*1 and 42*h*2 are firstly formed on the central part of the plate type member having a rectangular shape in front view and made of polycarbonate to form the game board main body 42*a*. Then, the laminated wood having the same thickness as that of the game board main body 42*a* is cut out to form the accessory fixing parts 42*b*1 and 42*b*2. Then, the accessory fixing parts 42*b*1 and 42*b*2 are respectively fitted to the holes 42*h*1 and 42*h*2 of the game board main body 42*a* and fixed thereto by, for example, an adhesive agent. Subsequently, the bumpers 51, the flippers 52 and the frame members 53 are fixed to prescribed positions in the accessory fixing parts 42*b*1 and 42*b*2 fitted to the game board main body 42*a* by fastening the fixing screws. In this case, the accessory fixing parts 42*b*1 and 42*b*2 are formed with the laminated wood having flexibility. Accordingly, even when the fixing screws are tightly fastened, the bumpers 51, the flippers 52 and the frame members 53 are reliably fixed to the accessory fixing parts without breaking the accessory fixing parts 42*b*1 and 42*b*2. Thus, the game board 42 is completed.

In the pinball machine 41, when a power source is turned on, a main control part 3 outputs a command C1 for displaying an image G41 for a game in an initial state shown in, for instance, FIG. 7. A display control part 12 performs the above-described image display process in response thereto to form displaying image data Dg in a VRAM15 and output the formed displaying image data Dg to the projector unit 31. Then, the projector unit 31 projects projection light L for displaying the image G41 for a game on the basis of the displaying image data Dg. At this time, as shown in FIG. 8, the mirror 62 reflects the projection light L. The projection light L is converted to parallel light by the Fresnel lens 63 and projected on the screen film 61. Thus, as shown in FIG. 7, the image G41 for a game in the initial state formed on the screen film 61 is displayed on the image display part 42*a*1 of the game board main body 42*a*. In this case, as the image G41 for a game, characters representing the name of the type of the pinball machine 41 (in this case, characters of "Beetle Story") as one example and animation images of wood or insects are displayed.

Figure 10:
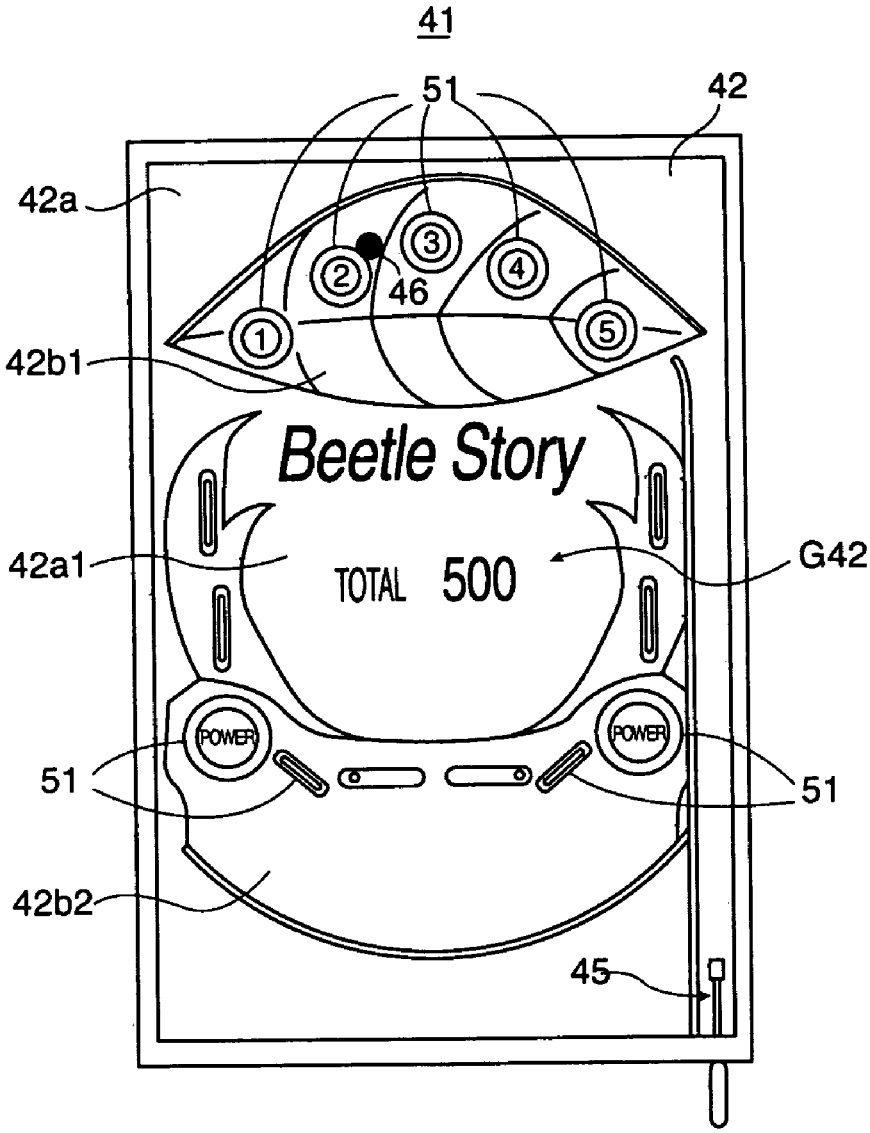
FIG. 10 is a plan view of the pinball machine 41 in which an image G42 for a game is displayed.

Then, as shown in FIG. 10, when a pinball game is started and the game balls 46 are driven to the interior (in FIG. 10, an upper side) of the game board 42 by a driving mechanism 45, the game balls 46 move to a front side (in FIG. 10, a lower side) on the game board 42. At this time, when the game balls 46 collide with the bumpers 51, the bumpers 51 spring back the game balls 46 and detect the collision of the game balls 46 to output detecting signals to the main control part 3. In this case, the laminated wood with which the accessory fixing parts 42*b*1 and 42*b*2 are formed holds the fixing screws with a sufficient holding force, so that the bumpers 51 (via fixing screws) are prevented from being loosened due to impacts upon collision of the game balls 46. Subsequently, the main control part 3 calculates a score based on the detecting signals outputted from the bumpers 51 and outputs a command C1 for displaying an image G42 for a game including characters showing the score to the display control part 12. Then, the display control part 12 performs an image process in accordance with the command C1. Thus, as shown in FIG. 10, the image G42 for a game including the characters showing the score is displayed on the image display part 42*a*1 of the game board main body 42*a*. Every time the game balls 46 collide with the bumpers 51, the above-described processes are performed. In this case, the size of the characters is changed or various kinds of animation images for representation are changed in accordance with the score (total score), so that the image G42 for a game can be changed in various ways.

As described above, in the pinball machine 41, the game board 42 comprises the game board main body 42*a* and the accessory fixing parts 42*b*1 and 42*b*2 formed separately from the game board main body 42*a* and attached to the game board main body 42*a*. Thus, the game board main body 42*a* and the accessory fixing parts 42*b*1 and 42*b*2 can be formed with different materials. Accordingly, the accessory fixing parts 42*b*1 and 42*b*2 can be formed with the laminated wood with a suitable flexibility. Consequently, the accessory fixing parts 42*b*1 and 42*b*2 and the game board main body 42*a* can be prevented from being broken due to the fastening operation of the fixing screws for fixing such as the bumpers 51. Further, since the accessory fixing parts 42*b*1 and 42*b*2 have a sufficient holding force relative to the screwed fixing screws, the loosening of the bumpers 51 (via fixing screws) due to impacts with the game balls 46 during a game can be prevented. Further, the accessory fixing parts 42*b*1 and 42*b*2 are respectively fitted to the holes 42*h*1 and 42*h*2 of the game board main body 42*a*. Accordingly, the surface of the game board main body 42*a* can be flush with the surfaces of the accessory fixing parts 42*b*1 and 42*b*2 without generating steps. Accordingly, the game balls 46 can be smoothly moved. Further, since the accessory fixing part 42*b*1 is formed in the shape imitating a leaf and the accessory fixing part 42*b*2 is formed in the shape imitating an insect, both the accessory fixing parts 42*b*1 and 42*b*2 can function as parts of the picture patterns.

The present invention is not limited to the above-described embodiments. For instance, in the embodiment of the present invention, although an example that the nail fixing parts 21*b*1 and 21*b*2 and the accessory fixing parts 42*b*1 and 42*b*2 are formed with laminated wood is described, the material of the nail fixing parts 21*b*1 and 21*b*2 and the accessory fixing parts 42*b*1 and 42*b*2 is not limited thereto. They may be formed with various kinds of wooden members such as a wooden plate, a wooden laminated lumber, a particle board (plate type product formed by wooden chips, wooden flakes, etc.) and a single plate laminated material. Further, they may be formed with a sheet member (sheet like material) such as a hard and thick sheet. Further, the above-described fixing parts may be formed with a combined material (compound material) of various kinds of wooden members and the sheet member. Even when these structures are employed, the same effects as those of the pachinko machine board 1 and the pinball machine 41 according to the embodiments of the present invention can be obtained.

Further, in the above-described embodiment, although an example that the nail fixing parts 21*b*1 and 21*b*2 are fitted to the holes 21*h*1 and 21*h*2 formed on the game board main body 21*a* to form the game board 21 is described, a method for producing the game board 21 is not limited thereto. For instance, the previously manufactured nail fixing parts 21*b*1 and 21*b*2 are set in a (e.g., metal) mold for forming the game board main body 21*a*. Then, a light transmitting resin is injected thereto so that the game board main body 21*a* can be formed integrally with the nail fixing parts 21*b*1 and 21*b*2. In the same manner as mentioned above, the previously formed accessory fixing parts 42*b*1 and 42*b*2 are set in a mold for forming the game board main body 42*a* and a light transmitting resin is injected thereto so that the game board main body 42*a* can be formed integrally with the accessory fixing parts 42*b*1 and 42*b*2.

Further, the nail fixing parts 21*b*1 and 21*b*2 and the accessory fixing parts 42*b*1 and 42*b*2 can be formed in shapes imitating imaginary creatures such as a dragon or characters of comics as well as other animals or landscapes, in the shapes imitating artificial objects such as a vehicle, a robot and living necessaries and in the shapes imitating characters and symbols. Further, in the embodiments of the present invention, although the game board 21 on which the two nail fixing parts 21*b*1 and 21*b*2 are disposed and the game board 42 on which the two accessory fixing parts 42*b*1 and 42*b*2 are provided are described as examples, the number of the nail fixing parts and the accessory fixing parts is not limited thereto. An arbitrary number of one or more of the nail fixing parts or the accessory fixing parts can be disposed. Further, the material of the game board main body 21*a* and the game body main body 42*a* is not limited to polycarbonate and other arbitrary light transmitting materials may be employed.

The entire disclosure of Japanese Application Nos. 2002-233882 filed Aug. 9, 2002 and 2003-166840 filed Jun. 11, 2003 are incorporated by reference.

What is claimed is:

1. A game machine comprising:

a game board on which at least one of nails and accessories are fixed; and a projection mechanism which projects projection light from a rear surface of the game board to display images for a game on the game board;

wherein the game board includes:

a game board main body made of a light transmitting material to display the images for the game; and fixing parts which are formed on a separate layer from the game board main body, the separate layer having a thickness that is the same as a thickness of the game board main body; and wherein the separate layer is nested in and attached to the game board main body with at least one of the nails and the accessories being fixed to the separate layer, a surface of the separate layer is flush with a surface of the game board main body when the separate layer is nested within the game board main body, and the separate layer is comprised of laminated wood formed by sequentially laminating wooden thin plates so that a direction of fibers of the separate layer intersect perpendicularly.

2. A game machine according to claim 1, wherein the fixing parts are configured in forms imitating at least one of actual creatures, imaginary creatures, artificial objects, landscapes, characters and symbols.

3. A game machine comprising:

a game board; and a projection mechanism projecting projection light from a rear surface of the game board to display images for a game on the game board;

wherein the game board includes:

a polycarbonate game board main body displaying the images for the game; and wood fixing parts nested within cavities formed within the game board main body, with at least one of nails and screws being driven into said wood fixing parts;

wherein the wood fixing parts are formed on a separate layer from the game board main body, the separate layer having a thickness that is the same as a thickness of the game board main body, a surface of the separate layer being flush with a surface of the game board main body when the wood fixing parts are nested within the cavities formed within the game board main body, and the separate layer being comprised of laminated wood formed by sequentially laminating wooden thin plates so that a direction of fibers of the separate layer intersect perpendicularly.

4. The game machine of claim 3 wherein said game board main body is light transmitting.

* * * * *